US005152659A

United States Patent [19]

Waka

[11] Patent Number: 5,152,659

[45] Date of Patent: Oct. 6, 1992

[54] BOOM ASSEMBLY FOR WORK MACHINE

[75] Inventor: Toshihiko Waka, Osaka, Japan

[73] Assignee: Kubota Corporation, Osaka, Japan

[21] Appl. No.: 582,056

[22] Filed: Sep. 14, 1990

[30] Foreign Application Priority Data

Dec. 13, 1989 [JP] Japan ..... 1-323153

[51] Int. Cl.[5] ..... E02F 9/00

[52] U.S. Cl. ..... 414/722; 29/891; 29/897.2; 52/732; 52/632; 52/117; 212/266

[58] Field of Search ..... 414/686, 697, 722; 212/266, 269; 52/731, 732, 632, 117; 228/182; 29/891, 891.1, 891.2, 897.2, 897.31

[56] References Cited

U.S. PATENT DOCUMENTS

| | | | |
|---|---|---|---|
| 2,136,122 | 11/1938 | Almdale | 52/731 X |
| 2,776,080 | 1/1957 | Hapfeld | 52/732 X |
| 3,254,780 | 6/1966 | Midtbo . | |
| 3,890,696 | 6/1975 | Buske | 29/897.2 |
| 3,982,643 | 9/1976 | MacGregor | 414/686 |
| 4,002,000 | 1/1977 | Howard et al. | 52/731 X |
| 4,155,470 | 5/1979 | Moore et al. . | |
| 4,161,369 | 7/1979 | Moreno . | |
| 4,538,955 | 9/1985 | Langenfeld et al. | 414/697 X |

*Primary Examiner*—Michael S. Huppert

*Assistant Examiner*—Donald W. Underwood

[57] ABSTRACT

A boom assembly for a work machine comprising: a pair of first and second members of which one end pivot part is connected pivotally to a base machine and the second end pivot part supports a loading tool pivotally. An inflecting part is provided in the middle of the longitudinal direction of boom, and a cross tie member which ties the said first and second members in pairs near the loading tool. In order to form a first member which is connected to a tractor and a second member which supports a loading tool, with horizontal and vertical planes of upper and lower C-channels, the lower C-channel is inserted into the upper C-channel and its adjoining edges are welded. In order to form the inflecting part, the first member which is connected to a tractor and the second member which supports the loading tool are joined in a manner wherein the upper side of it is opened and the lower side is butt welded. Both side planes of the open part are covered and welded with side connecting plates, bridging and overlapping to the vertical planes of the upper channels, and the upper part of the open part is covered and welded with an upper connecting plate, bridging and overlapping to the horizontal planes of the upper channels.

14 Claims, 4 Drawing Sheets

BOOM ASSEMBLY FOR WORK MACHINE

BACKGROUND OF THE INVENTION

1. Field of the Invention

This invention is related to a boom assembly for a work machine used for a front end loading and a backhoe loading for the work machine.

2. Description of Background Art

A boom assembly with a reinforced torsional strength is disclosed which has the minimum effect of the strength of the boom and arm in other working modes, for example, as set forth in the specification of the U.S. Pat. No. 3,254,780, the specification of the U.S. Pat. No. 4,155,470 and the specification of the U.S. Pat. No. 4,161,369.

In the above mentioned conventional techniques, a box type boom arm is formed by overlapping an inward facing channel and outward facing channel having horizontal and vertical planes which are welded along adjoining edges. The boom arms are joined by a pair of cross tie members.

As the welding line of the adjoined edges is formed along the whole longitudinal direction of the upper and lower faces of the boom, it was very difficult to maintain the box type for a long period.

Namely, the welded parts which have the welding lines both in the upper and lower faces of the boom were easy to separate due to the repetition of tensile and compressive stresses, above all, torsional stress by the loading work of the boom.

Further, the weld presented a bad appearance which is a factor causing a lower value of the commodity by having the welding lines both in the upper and lower faces of the boom, even if the booms were finished by painting.

Moreover, as the boom arm has an inflecting part, it was very difficult to manufacture a pair of the inward and outward facing C-channels in one piece having an inflecting part.

OBJECT AND SUMMARY OF THE INVENTION

The first object of the invention is to provide a boom assembly that can maintain a box-type for a long period, reducing the torsional load to the welded portion. In order to form the box type boom arm with a pair of C-channels, the lower channel is inserted into the upper C-channel and its adjoining edges are welded.

The second object of the invention is to provide a boom assembly which has a good appearance and an improved value of the commodity by setting the welding line not on the upper side, but on the lower side in the longitudinal direction of the boom.

Further, the third object of the invention is to provide a boom assembly that can be easily manufactured, even if there is an inflecting part, by dividing No. 1 boom arm and No. 2 boom arm at the inflecting part, and butt welding both arms which are also joined with side and upper plates.

In order to obtain the above mentioned objects, this invention has the following features in the boom assembly which comprising a pair of boom arms 10, having at one end a pivot part 11 which is pivotally connected to a base machine and at another end a pivot part 14 which supports pivotally a loading tool 15. A middle portion in the longitudinal direction has an inflecting part 13, and, a cross tie member 21 which ties the boom arms in pairs near the loading tool 15.

The invention has a feature comprising: a pair of upper and lower C-channels 26, 29 which have horizontal planes 24, 27 and vertical planes 25, 28; and to form a first member 22 connecting to the base machine 1 and a second member 23 supporting a loading tool 15, an inserted adjoining part 30 is formed by inserting the lower C-channel 29 into the upper C-channel 26 and welding the members together. The first member 22 is connected to the base machine 1 and the second member 23 which supports the loading tool 15. The upper side of the first and second members 22, 23 are opened. The lower side of the first and second members 22, 23 are butt-welded to form the inflecting part 13. Both side planes of the open part are covered and welded by side-connecting plates 35 overlapping and bridging the vertical planes 25 of the upper channels 26. The upper part of the open part which is covered and welded by an upper connecting plate 36 overlapping and bridging to the horizontal planes 24 of the upper channels 26.

Also, the invention has another feature wherein the cross tie member 21 penetrates through the vertical planes 25 of the upper C-channels 26 in the pair of second members 23 that support the loading tool 15 which is welded to the vertical planes 25.

Further, the invention has an additional feature wherein the cross tie member 21 penetrates through the vertical planes 25, 28 of the upper and lower C-channels 26, 29 in the pair of second members 23 which support the loading tool 15 which is welded to the vertical planes 25 of the upper C-channel 26, or to the vertical planes 25 and the vertical planes 28 of the lower C-channels 29.

The invention has an additional feature wherein the pivot part 11 of one end portion and the pivot part 14 of another end portion penetrates through the vertical planes 25 of the upper C-channels 26 which are constructed by welding with circular tubes 31, 32 to the vertical planes 25.

Moreover, the invention has additional features wherein the cross-sections of the first members 22 connected to the tractor 1 are manufactured so as to become gradually larger from the pivot part 11 toward the inflecting part 13. In addition, the cross-sections of the box-type boom-arms 23 supporting the loading tool 15 are manufactured to become gradually larger from the pivot part 14 towards the inflecting part 13.

According to the invention, in order to form the first members 22 connected to the base machine 1 and the second members 23 supporting the loading tool 15, the inserted adjoining edge parts 30 are welded in the shape that the lower C-channels 29 are inserted into the upper C-channels 26, so the torsional load acting on a boom-arm 10 is received by the vertical planes 25, 28 and the horizontal planes 24, 27 of both the channels 26, 29, and the load to the welded joining edge parts is lightened.

The appearance is improved by forming the welding lines, i.e. the joining parts, not on the upper sides, but on the lower sides.

Further, in order to form the inflecting part 13, the first member 22 connected to the base machine 1 and the second member 23 supporting the loading tool 15 is joined in the shape that the upper side is open-mouthed and the lower side is butt-welded. Both side planes of the open mouthed parts are covered by the side tie plates 35 bridged, overlapped and welded to the vertical planes 25 of the upper C-channels 26. The upper part of the open-mouthed part is covered by the upper tie plate 36 overlapped and welded bridging to the horizontal planes 24 of the upper channels 26. Thus, even if the inflecting part is in the middle of the longitudinal direction of the boom, the boom assembly can be easily and accurately manufactured.

The cross-tie member 21 penetrates through the vertical planes 25 of the upper C-channels 26 in the pair of the second members 23 supporting the loading tool 15 and is welded to the vertical planes 25. The cross-tie member 21 penetrates through the vertical planes 25, 28 of the upper and lower C-channels 26, 29 in the pair of the second members 23 supporting the loading tool 15, and is welded to the vertical planes 25 of the upper C-channels 26, or to the vertical planes 25 and the vertical planes 28 of the lower C-channels 29. Hence, the torsional rigidity to the whole boom assembly is improved.

Further, the pivot parts 11, 14 penetrate through the vertical planes 25 of the upper C-channels 26 and are welded with the circular tubes 31, 32 connecting the vertical planes 25 together. Hence, the improvement for the rigidity of the vertical planes 25 can be expected by reinforcing with the circular tubes 31, 32.

And the cross-sectional shape of the box-type boom arms 22 connected to the base machine 1 is formed to become gradually larger from the pivots parts 11 toward the inflecting parts 13, and also the cross-sectional shape of the second member 23 supporting the loading tool 15 is formed to become gradually larger from the pivot parts 14 toward the inflecting parts 13. Hence, the boom-arm assembly is constructed with minimum required members, realizing a larger rigidity, without making a larger size than it requires.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

The working example of the invention is described in detail referring to drawings below.

Figure 9:
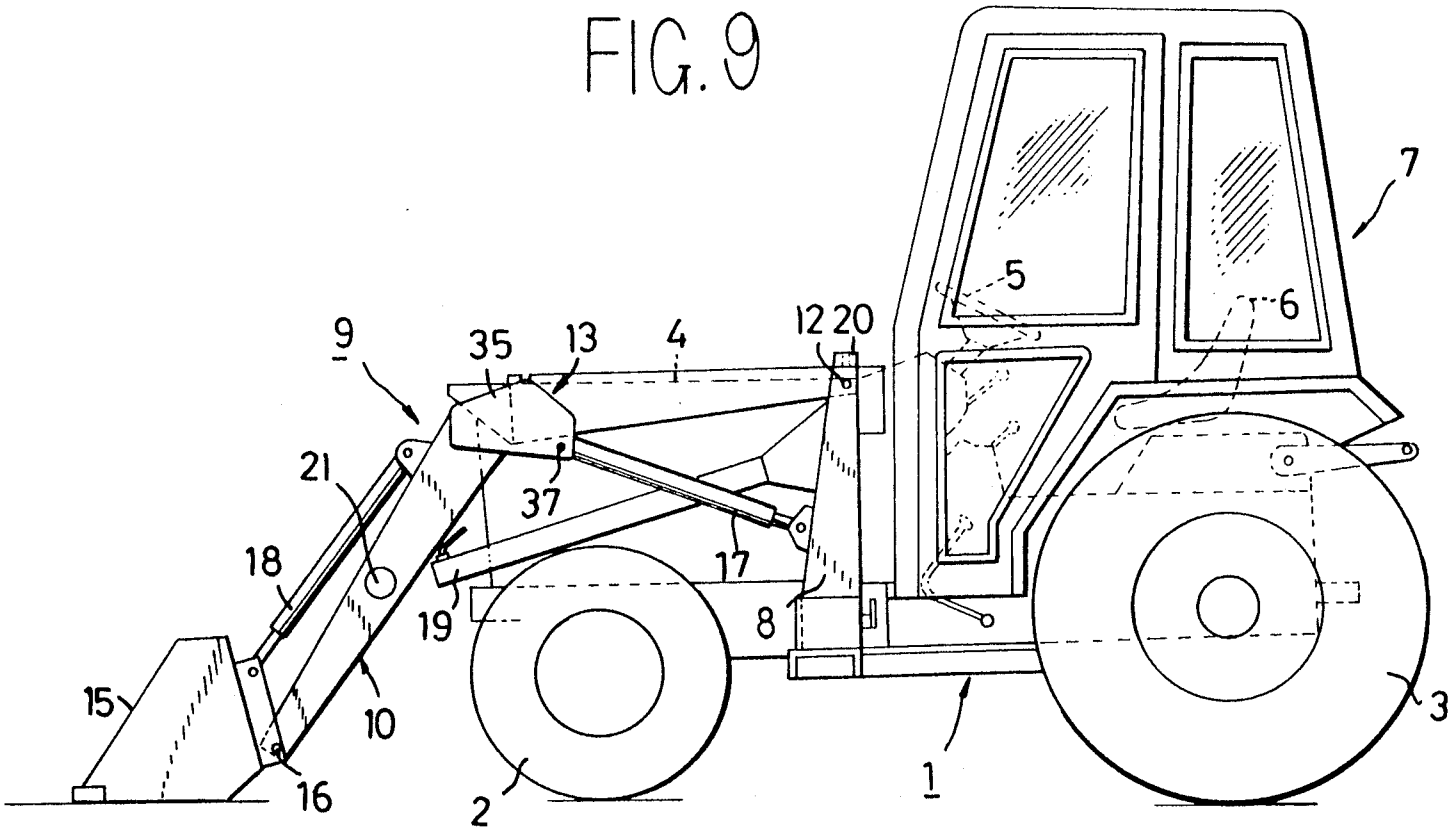
FIG. 9 is a general view of a tractor type loader.

In FIG. 9, a tractor as a base machine 1 is a two axle four wheeler vehicle having a front wheel 2 and a rear wheel 3. A steering device comprising a steering handle 5 and a driver's seat 6 is placed in the rear part of a bonnet 4 which covers an engine, and is covered by a cabin 7.

In the tractor 1, a pair of mast frames 8 is fixed in the middle of the chassis, substantially in both sides in left and right between the front wheel 2 and the rear wheel 3, and a front loader 9 is attached to the tractor 1.

The loader 9 having a pair of boom arms 10 in left and right sides is connected pivotally to the upper part of the mast frames 8 at a pivot part 11 in one end of the arm by a pin shaft 12, and extends forward in the right and left side of the bonnet 4, and extends farther over an inflecting part 13 which is approximately half way, a loading tool 15 shown as a bucket is supported workably at a pivot part 14 of another end of the arm by a pin shaft 16.

The loader 9 includes the boom arm 10 which is swung by a boom cylinder 17, making the pin shaft 12 as a round end, and the loading tool 15 is moved by a bucket cylinder 18, making the pin shaft 16 as a round end, thereby, a loading work can be implemented. The loader 9 includes a bracing member 19 and the mast frames 8 connected to each other by a tie member 20 crossing over the bonnet 4 between the left and right mast frames 8, and having a pair of the right and left boom arms 10 connected to each other by a cross tie member 21, is improved to have a higher rigidity of the loader, especially, the whole torsional rigidity. The cross tie member 21 is set in front of the bonnet 4 and evades a collision with the bonnet 4 even in the swinging motion of the boom.

Referring to FIG. 1 to FIG. 8, a pair of left and right boom arms 10 is illustrated in detail.

The boom arm 1 is constructed with the first box type boom arm 22 connected to the tractor 1, substantially to the mast frames 8, or through the mast frames 8 and the second box type boom arm 23 supporting the loading tool 15, by joining each other at the inflecting part 13.

The first and second members 22, 23 are formed into a box-type combining with an upper C-channel 26 having a horizontal plane 24 and vertical planes 25, and a lower C-channel having a horizontal plane 27 and vertical planes 28, substantially, by inserting the vertical planes 28 of the lower C-channel 29 into the space between the vertical planes 28 of the upper C-channel 26. Here, welding lines do not appear in the upper side, but in the lower side of the boom longitudinally.

Figure 8:
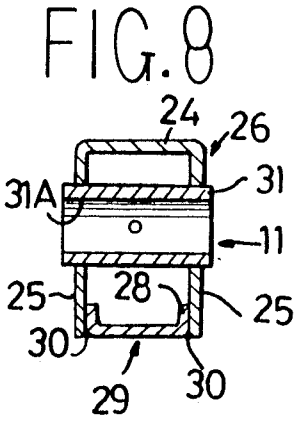
FIG. 8 is a section view taken along line B—B in FIG. 1.

As shown in FIG. 8, in the first member 22 the pivot part 11 is formed in a manner wherein a circular tube of which inner hole 31A is an inserting hole of the pin shaft 12, penetrates through holes perforated in the vertical panes 25 of the upper channel 26 and is welded to the vertical planes 25, thus, the torsional rigidity of the pivot part 11 is greatly improved.

Figures 1, 3, 4, 5:
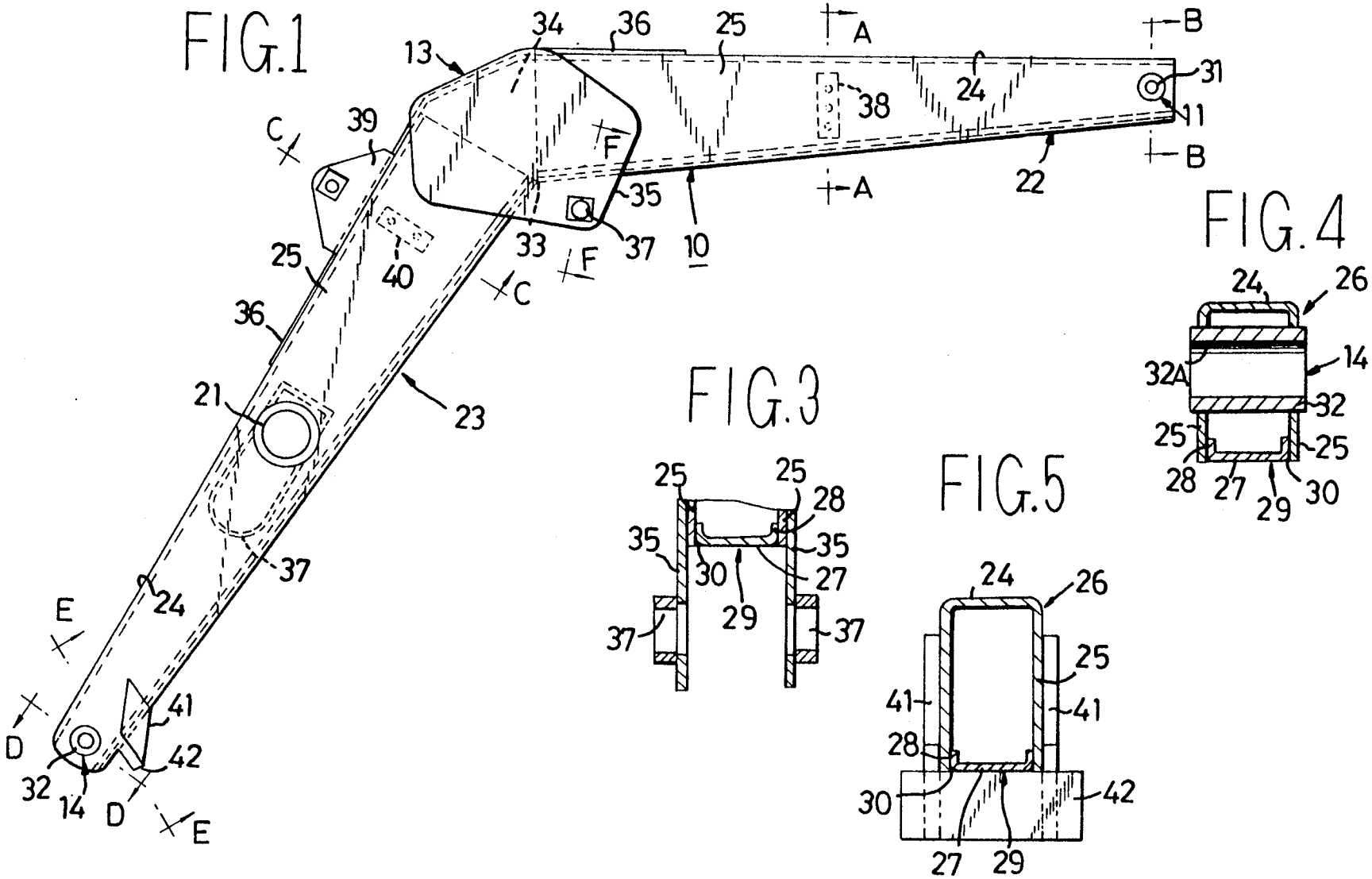
FIG. 1 is a side view of the boom assembly in the working example of the invention.
FIG. 3 is a section view taken along line F—F in FIG. 1.
FIG. 4 is a section view taken along line D—D in FIG. 1.
FIG. 5 is a section view taken along line E—E in FIG. 1.

Also, as shown in FIG. 4, in the second member 23 the pivot pat 14 is formed in a manner wherein a circular tube 32 of which an inner hole 32A is an inserting hole of the pin shaft 16, penetrates through holes perforated in the vertical planes 25 of the upper channel and is welded to the vertical planes 25, thus the torsional rigidity of the pivot part 14 is greatly improved.

The first member 22 and the second member 23 are, as shown in FIG. 1, joined and welded at each lower side 33, and have an open part 34 of which both side planes are welded with side connecting planes 35 bridging and overlapping to the vertical planes 25 of the first member 22 and the vertical planes 25 of the second member 23, and of which upper side is welded with an upper connecting plane 36, bridging and overlapping to the horizontal plane 24 of the first member 22 and the horizontal plane 24 of the second member 23. Thus, forming the inflecting part 13 by closing the open part 24, the boom arm assembly is formed almost like an L-shape in a view from the side. Both sides of the side connecting planes 35, as shown in FIG. 3, include pivot parts 37 which are formed to set a boom cylinder.

The first member 22 is enlarged in its sectional shape from the pivot part 11 toward the inflecting part 13. Therefore, the width of the vertical planes 25 is gradually increased. Also the second boom arm 23 is enlarged in its sectional shape from the pivot part 14 toward the inflecting part 13. Hence, the width of the vertical planes 25 is gradually increased. Here, the boom assembly 10 has a maximum sectional shape at the inflecting part 13.

Figure 2:
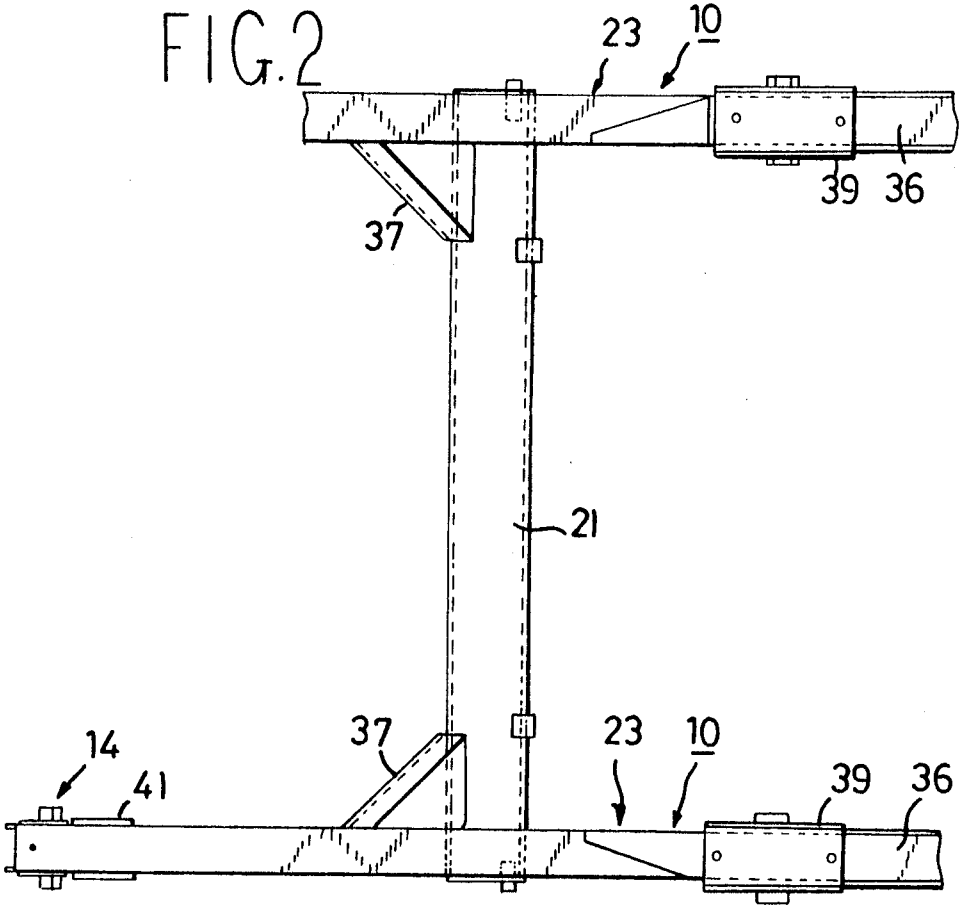
FIG. 2 is a top view of a main part of the boom assembly.
Figure 10:
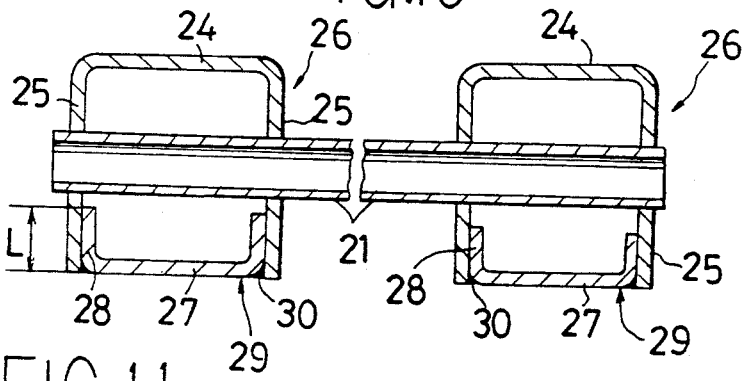
FIG. 10 is a section view showing the connecting part of the cross tie member.

The cross tie member 21 penetrates through the vertical planes 25 of a pair of arms at the halfway of the longitudinal direction of the second member 23, and is welded to the vertical planes 25 (see FIG. 2 and FIG. 10). And corner pieces 37 are welded to the crossing parts of both ends of the cross tie member 21 and the arms.

Figure 7:
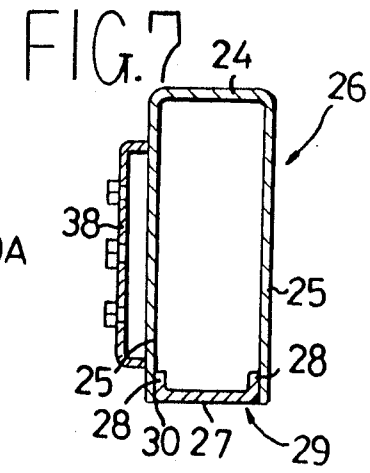
FIG. 7 is a section view taken along line A—A in FIG. 1.
Figure 6:
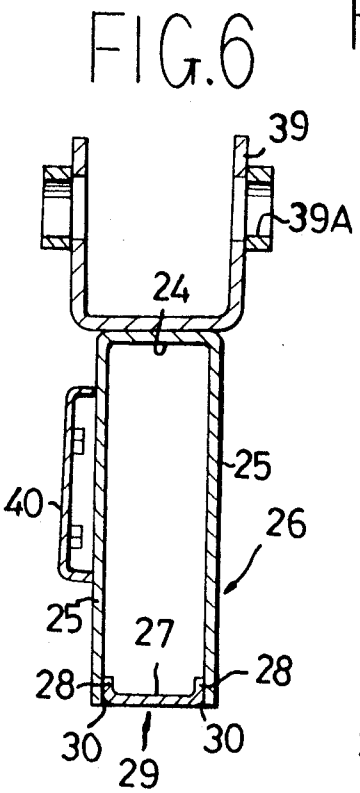
FIG. 6 is a section view taken along line C—C in FIG. 1.

As shown in FIG. 1 and FIG. 7, brackets 38 used for fixing pipings of the boom cylinder, are welded to the inner side planes of the first member 22. And, as shown in FIG. 1 and FIG. 6, brackets 39 used for connecting a bucket cylinder 18 through pivot holes 39A and bracket 40 are used for fixing pipings of the bucket cylinder which are welded to the inner side and upper planes of the second member 23.

Further, as shown in FIG. 1 and FIG. 5, a reversion arrestor 42 is welded near the pivot part 14 of the second member 23 backed up by a doubling 41.

Figure 11:
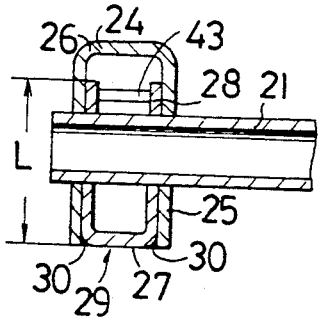
FIG. 11 to FIG. 13 are main section view of No. 2 to No. 4 working examples.
Figure 12:
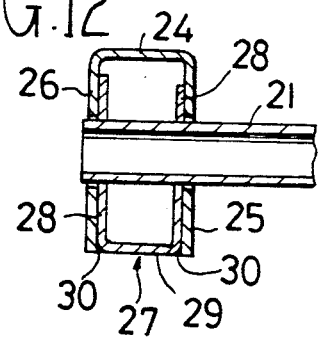

The torsional rigidity of the first and second members 22, 23 in a box-type can be adjusted to be optimal in accordance with the kind of loaders by setting the inserting depth of the vertical planes 28 of the lower C-channel 29 to the vertical planes 25 of the upper C-channel, and as shown in FIG. 11, when the above mentioned inserting depth L becomes larger, distance pieces 43 such as bars and pipes which tie the vertical planes 28 of the lower C-channel 29 are desirable to weld with an interval toward the longitudinal direction of the arm. The distance function can also be made by using the cross tie member 21. As shown in FIG. 12, in this case the vertical planes 25, 28 of the upper and lower C-channels are welded together.

Figure 13:
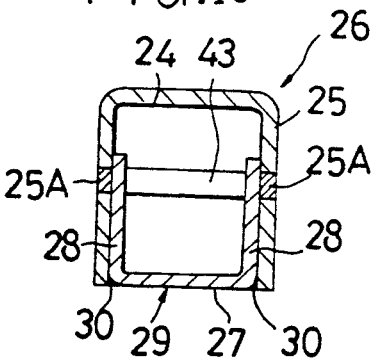

Further, as shown in FIG. 13, the distance pieces 43 can be welded through holes 25A perforated to the vertical planes 25 of the upper C-channel 26.

Figure 14:
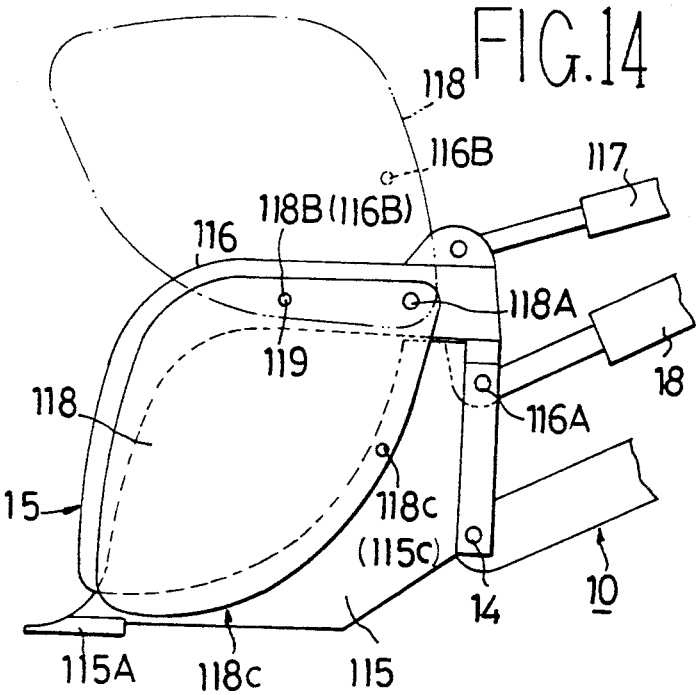
FIG. 14 is a side view showing other example of loading tools.
Figure 15:
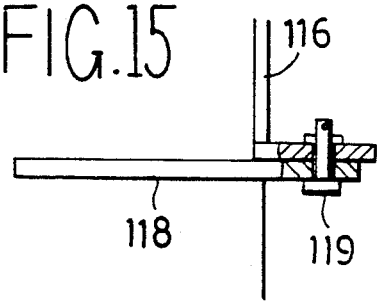
FIG. 15 is a partially sectional top view of FIG. 4.

As shown in FIG. 9, a bucket or a fork is attachable as a loading tool 15, and also, a loading tool as shown in FIG. 14 and FIG. 15 is attachable.

In the loading tool 15 shown in FIG. 14 and FIG. 15, a lower bucket 115 which is supported pivotally at the pivot part 14 has a cutting edge 115A at its edge and is turned pivotally by a bucket cylinder 18, and a fork edge 116 is attached pivotally to the lower bucket 115 by a pin 116A and is turned to open and shut it by a cylinder 117 using the pin 116A as a fulcrum.

Side plates 118 which are attached to both sides of the lower bucket 115 are attached pivotally to the fork edge 116 using the pin 118A as a fulcrum. One of the two holes 118B and 118C formed in the side plates 118 is selected by a pin 119 to a hole 115B formed in the side plane of the lower bucket 115 and a hole 116B formed in the fork edge 116. Hence, keeping the side plates 118 at the position shown in dotted lines of FIG. 14, a loading work for bars can be carried out by switching to open and shut, and a bulk loading can also be carried out by setting the side plates 118 to the position shown in solid lines of FIG. 14. Further, an action of side cutting can be done by making a lower edge 118C of the side plates 118 a knife edge.

In addition to the above illustrated loaders, the boom assembly of the invention can be applied to a backhoe.

As stated above, the invention has many improvements for increasing the individual torsional rigidity of the first and second members of the boom arms and the whole torsional rigidity of the boom assembly, for increasing the value of the commodity by eliminating the welding line from the upper side of the boom toward its longitudinal direction and for manufacturing it easily, and it has a great many actual merits for the boom assembly using loaders and backhoes.

I claim:

1. A boom assembly for a work machine comprising:

a pair of boom arms of which one end of each arm is connected pivotally at a pivot part to a work machine and a second pivot part of another end of each arm supports pivotally a loading tool, said boom arms include inflecting parts;

a cross tie member for tying the pair of boom arms to each other near the loading tool;

each said boom arm includes a first member which is connected to the work machine and a second member which supports the loading tool, each said first and second members are formed from a pair of upper and lower C-channels which have horizontal and vertical planes, the lower C-channel is inserted into the upper C-channel and welded along the adjoining edges;

each said inflecting part being formed between one of said first members connected to the work machine and of the second members which supports the loading tool by an opening in vertical sides and an upper side and a butt weld in a lower side, and both sides of the opening are covered by side connecting plates bridging and overlapping to the vertical planes of the upper channels and welded together, and the upper side of the opening is covered and welded with an upper connecting plate bridging and overlapping to the horizontal planes of the upper channels;

said cross tie member penetrating through the vertical planes of the upper C-channels in the pair of second members which supports the loading tool, and is welded in the vertical planes.

2. A boom assembly for a work machine according to claim 1, wherein said one end pivot part and said second end pivot part are formed by welding a circular tube penetrating through the vertical planes of the upper C-channels in said vertical plane.

3. A boom assembly for a work machine according to claim 1, wherein the first member connected to the work machine is enlarged gradually in its sectional shape from said one end pivot part toward the inflecting part, and the second member for supporting the loading tool is enlarged gradually in its sectional shape from said second pivot part toward the inflecting part.

4. A boom assembly for a work machine according to claim 1, wherein said cross tie member penetrates through the vertical planes of the upper and lower C-channels in the pair of the first and second members which supports the loading tool and is welded to the vertical planes of the lower C-channel.

5. A boom assembly for a work machine comprising:

a pair of boom arms of which one end of each arm is connected pivotally at a pivot part to a work machine and a second pivot part of another end of each arm supports pivotally a loading tool, said boom arms include inflecting parts;

a cross tie member for tying the pair of boom arms to each other near the loading tool;

each said boom arm includes a first member which is connected to the work machine and a second member which supports the loading tool, each said first and second members are formed from a pair of upper and lower C-channels which have horizontal and vertical planes, the lower C-channel is inserted into the upper C-channel and welded along the adjoining edges;

each said inflecting part being formed between one of said first member connected to the work machine and one of the second members which supports the loading tool by an opening in vertical sides and an upper side and a butt weld in a lower side, and both sides of the opening are covered by side connecting plates bridging and overlapping to the vertical planes of the upper channels and welded together, and the upper side of the opening is covered and welded with an upper connecting plate bridging and overlapping to the horizontal planes of the upper channels;

said cross tie member penetrating through the vertical planes of the upper and lower C-channels in the pair of the second members which supports the loading tool and is welded in the vertical planes of the upper C-channels.

6. A boom assembly for a work machine according to claim 5, wherein the first member connected to the work machine is enlarged gradually in its sectional shape from said one end pivot part toward the inflecting part, and the second member for supporting the loading tool is enlarged gradually in its sectional shape from said second pivot part toward the inflecting part.

7. A boom assembly for a work machine comprising:

a pair of boom arms of which one end of each arm is connected pivotally at a pivot part to a work machine and a second pivot part of another end of each arm supports pivotally a loading tool, said boom arms include inflecting parts;

a cross tie member for tying the pair of boom arms to each other near the loading tool;

each said boom arm includes a first member which is connected to the work machine and a second member which supports the loading tool, each said first and second members are formed from a pair of upper and lower C-channels which have horizontal and vertical planes, the lower C-channel is inserted into the upper C-channel and welded along the adjoining edges;

each said inflecting part being formed between one of said first members connected to the work machine and of the second members which supports the loading tool by an opening in vertical sides and an upper side and a butt weld in a lower side, and both sides of the opening are covered by side connecting plates bridging and overlapping to the vertical planes of the upper channels and welded together, and the upper side of the opening is covered and welded with an upper connecting plate bridging and overlapping to the horizontal planes of the upper channels;

said one end pivot part and said second end pivot part being formed by welding a circular tube penetrating through the vertical planes of the upper C-channels in said vertical planes.

8. A boom assembly for a work machine according to claim 7, wherein the first member connected to the work machine is enlarged gradually in its sectional shape from said open end pivot part toward the inflecting part, and the second member for supporting the loading tool is enlarged gradually in its sectional shape from said second pivot part toward the inflecting part.

9. A boom assembly for a work machine according to claim 7, wherein said cross tie member penetrates through the vertical planes of the upper and lower C-channels in the pair of the second members which supports the loading tool and is welded in the vertical planes of the upper C-channels.

10. A boom assembly for a working machine comprising:

a first boom arm including a first member having a first end and a second end, said first end of said first member being adapted to be connected to a working machine, and a second member having a first end and a second end, said first end of said second member being operatively connected to the second end of said first member and said second end of said second member being adapted to be connected to a tool;

a second boom arm including first member having a first end and a second end, said first end of said first member being adapted to be connected to a working machine, and a second member having a first end and a second end, said first end of said second member being operatively connected to the second end of said first member and said second end of said second member being adapted to be connected to a tool;

a cross tie member for connecting said first boom arm to said second boom arm, said cross tie being positioned in proximity to said second end of said second members of both said first boom arm and said second boom arm;

said first member of said first boom arm being constructed of an upper substantially C-shaped channel and a lower substantially C-shaped channel, said upper and lower substantially C-shaped channels being positioned and secured one within the other to form a closed member;

said second member of said first boom arm being constructed of an upper substantially C-shaped channel and a lower substantially C-shaped channel, said upper and lower substantially C-shaped channels being positioned and secured one within the other to form a closed member;

said first member of said second boom arm being constructed of an upper substantially C-shaped channel and a lower substantially C-shaped channel, said upper and lower substantially C-shaped channels being positioned and secured one within the other to form a closed member;

said second member of said second boom arm being constructed of an upper substantially C-shaped channel and a lower substantially C-shaped channel, said upper and lower substantially C-shaped channels being positioned and secured one within the other to form a closed member;

a first boom arm first side tie plate being positioned to secure said first member and said second member of said first boom arm relative to each other;

a first boom arm second side tie plate being positioned to secure said first member and said second member of said first boom arm relative to each other;

a first boom arm upper connecting plate bridging and overlapping said first boom arm and said second boom arm for closing an opening formed therebetween;

a second boom arm first side tie plate being positioned to secure said first member and second member of said second boom arm relative to each other;

a second boom arm second side tie plate being positioned to secure said first member and said second member of said second boom arm relative to each other; and a second boom arm upper connecting plate bridging and overlapping said first boom arm and said second boom arm for closing an opening formed therebetween.

11. A boom assembly for a working machine according to claim 10, wherein the cross tie member penetrates through vertical planes of the upper C-channels in the pair of second members which supports the loading tool, and is welded in the vertical planes.

12. A boom assembly for a working machine according to claim 10, wherein said cross tie member penetrates through vertical planes of the upper and lower C-channels in the pair of second members which supports the loading tool and is welded in the vertical planes of the upper C-channels.

13. A boom assembly for a working machine according to claim 10, wherein one ned pivot part and a second end pivot part are formed by welding a circular tube penetrating through the vertical planes of the upper C-channels in said vertical planes.

14. A boom assembly of a working machine according to claim 10, wherein each first member connected to a working machine is enlarged gradually in its sectional shape from a pivot part at its first end toward its second end, and each second member which supports the loading tool is enlarged gradually in its sectional shape from a pivot part at its second end toward its first end.

* * * * *